US007884559B2

(12) United States Patent
Liu et al.

(10) Patent No.: US 7,884,559 B2
(45) Date of Patent: Feb. 8, 2011

(54) MULTI-ENERGY FREQUENCY-MULTIPLYING PARTICLE ACCELERATOR AND METHOD THEREOF

(75) Inventors: Yaohong Liu, Beijing (CN); Chuanxiang Tang, Beijing (CN); Haifeng Hu, Beijing (CN); Zhiqiang Chen, Beijing (CN); Yuanjing Li, Beijing (CN); Huaibi Chen, Beijing (CN); Huaping Tang, Beijing (CN); Jinsheng Liu, Beijing (CN); Jianjun Gao, Beijing (CN)

(73) Assignees: Tsinghua University, Beijing (CN); Nuctech Company Limited, Beijing (CN)

( * ) Notice: Subject to any disclaimer, the term of this patent is extended or adjusted under 35 U.S.C. 154(b) by 455 days.

(21) Appl. No.: 12/088,275

(22) PCT Filed: Oct. 11, 2007

(86) PCT No.: PCT/CN2007/002923

§ 371 (c)(1),
(2), (4) Date: May 8, 2008

(87) PCT Pub. No.: WO2008/052411

PCT Pub. Date: May 8, 2008

(65) Prior Publication Data

US 2010/0219776 A1 Sep. 2, 2010

(30) Foreign Application Priority Data

Oct. 11, 2006 (CN) ..... 2006 1 0113645

(51) Int. Cl.
*H05H 13/04* (2006.01)
*H05H 7/00* (2006.01)

(52) U.S. Cl. ..... 315/503; 315/500

(58) Field of Classification Search ..... 315/500, 315/501, 503, 505, 506
See application file for complete search history.

(56) References Cited

U.S. PATENT DOCUMENTS 5,451,794 A 9/1995 McKeown et al. ..... 250/492.3

(Continued)

FOREIGN PATENT DOCUMENTS

CN 2917188 Y 6/2007

(Continued)

OTHER PUBLICATIONS

"Search Report" for related Application No. PCT/CN2007/002923.

(Continued)

*Primary Examiner*—Douglas W Owens
*Assistant Examiner*—Minh D A
(74) *Attorney, Agent, or Firm*—Westman, Champlin & Kelly, P.A.

(57) ABSTRACT

A multi-energy frequency-multiplying particle accelerator and a method thereof are disclosed, an accelerator comprises a pulse power generation unit for generating N pulse signals with different power levels, N is equal to or greater than 2; N microwave power generation units for, under the control of a control signal, generating N microwaves with different energy levels based on said N pulse signals, respectively; a power mixing unit having N entrances and one exit and for inputting a corresponding microwave among said N microwaves from each of said N entrances and outputting said N microwaves from said one exit; a particle beam generation unit for generating N particle beams in synchronization with said N microwaves; and an accelerating unit for using said N microwaves to accelerate said N particle beams, respectively.

13 Claims, 7 Drawing Sheets

U.S. PATENT DOCUMENTS

| | | | | |
|---|---|---|---|---|
| 6,060,833 | A * | 5/2000 | Velazco | 315/5.41 |
| 6,429,608 | B1 * | 8/2002 | Lyons et al. | 315/500 |
| 6,441,569 | B1 * | 8/2002 | Janzow | 315/502 |
| 6,844,689 | B1 * | 1/2005 | Brown et al. | 315/505 |
| 2004/0202272 | A1 | 10/2004 | Yao et al. | 376/120 |

FOREIGN PATENT DOCUMENTS

| | | | |
|---|---|---|---|
| CN | 1997256 | A | 7/2007 |
| CN | 200987235 | Y | 12/2007 |
| WO | WO 93/14419 | | 7/1993 |
| WO | WO 2004/030162 | A2 | 4/2004 |
| WO | WO 2005/111590 | | 11/2005 |

OTHER PUBLICATIONS

"Written Opinion" for related Application No. PCT/CN2007/002923.

* cited by examiner

MULTI-ENERGY FREQUENCY-MULTIPLYING PARTICLE ACCELERATOR AND METHOD THEREOF

CROSS-REFERENCE TO RELATED APPLICATION

This Application is a Section 371 National Stage Application of International Application No. PCT/CN2007/002923, filed Oct. 11, 2007, not yet published, the content of which is hereby incorporated by reference in its entirety.

BACKGROUND OF THE INVENTION

1. Field of Invention

The present invention relates to accelerator technology, in particular to a multi-energy frequency-multiplying particle accelerator having simple structure and improved operating speed as well as a method thereof.

2. Description of Prior Art

Electron accelerators have enjoyed wide popularity in various application fields such as industrial non-destructive inspection, customs container inspection, radioactive medicine and electron beam radiation processing. For example, high-energy CT equipment, which are used to check whether there is a defect in boiler, motors, mechanical arm frames, missiles, etc., have been applied in inspection on luggage, parcels and containers in airports, customs and other public places. With such equipment, it is possible to find contraband goods, such as guns, knives, dynamites, drugs and mass destructive weapons, as well as various smuggled goods inconsistent with declaration bills. A typical radiation inspection system is composed of a ray source, a detector subsystem and an imaging device. When an object to be inspected is moving along the passage between the ray source and the detector, radiation rays generated by the ray source, such as X-rays, γ-rays and neutrons, penetrate through the object and then are detected and measured by the detector. Since the intensity of the rays is weakened when the rays penetrate the object, and the degree of weakening depends on the material and density of the object, the ray intensity measured by the detector is the function of the material and density of the object. Finally, the imaging device produces an image reflecting the shape, size and density of the object by processing and analyzing the measurement result by the detector.

In addition, electron accelerators are widely applied in the fields of radioactive medicine and radiation processing, such as tumour treatment, radiation disinfection, radiation pasteurization, radiation quarantine, radiation decomposition, radiation crosslinking and radiation property changing. In the field of radiation processing, the dominant technical criterion for an accelerator is radiation processing capability, that is, the energy of an electron beam and beam current power. The electron beam energy determines the depth of radiation processing, the higher the electron beam energy is, the greater the depth of radiation processing becomes. In other words, with higher electron beam energy, it is possible to penetrate an object of to greater bulk (depth). On the other hand, the beam current power determines the speed of radiograph processing, that is, for the same period of time, the higher the beam current power is, the larger the number of the objects subjected to radiation processing is.

A dual- or multi-energy electron accelerator is an electron accelerator system capable of outputting electron beam current with two or more energy levels. Compared with the conventional electron accelerator system of a single energy level, the dual- or multi-energy electron accelerator, besides its diversification of the single-energy mechanism, has a more impressive technical advantage of incorporating new-generation systems of detection, digital image processing and the like so as to distinguish between different substance materials. Traditionally, the single-energy accelerator system can identify only the shape of an object when used in industrial non-destructive inspection, customs container inspection, high-energy CT and other fields, while the dual- or multi-energy electron accelerator system can identify both the shape and the material of an object and thus effectively find out dynamites, drugs, weapons or other poisonous substance and contraband goods hidden in large-sized containers during trans-border shipping. As a result, the dual- or multi-energy electron accelerator system enjoys a broader prospect in many applications.

For the purpose of substance identification, Patent Document 1 (WO 9314419A1) proposes such a configuration that two accelerators of different energy levels operate in parallel to perform radiation scanning imaging on the same object, respectively, and the two generated images are compared to obtain information on the material of the object. Meanwhile, Patent Document 2(WO 2005111950A1) also provides a dual-ray solution by causing two accelerators to bomb the same target along different directions. Unfortunately, the above configurations each require two accelerators and two independent detector systems, thereby involving more equipment, higher expenditure and larger occupied area.

Moreover, Patent Document 3(US 2004202272 A1) sets forth a multi-energy particle beam accelerator which produces a particle beam having the first energy in the first operating mode and a particle beam having the second energy in the second operating mode, in which the particle beams having two energy levels are obtained by repeatedly inserting/taking some object into/from the chamber of a beamforming section so as to change the shape of the chamber, that is, to change resonant frequency and the distribution of electromagnetic field within the chamber.

The solution described in the above Patent Document 3, however, utilizes certain mechanical means to achieve the switching from the first particle beam to the second particle beam, which cannot meet the requirement for a switching speed of millisecond order in some applications. Therefore, it is desirable to develop a multi-energy electron accelerator which can overcome the problem of complicated structure with the configuration of two accelerators while satisfying the requirement on operating performance.

SUMMARY OF THE INVENTION

The present invention is made in view of the above problems. The object of the present invention is to provide a multi-energy frequency-multiplying particle accelerator having simple structure and improved operating speed as well as a method thereof.

In an aspect of the present invention, a multi-energy frequency-multiplying particle accelerator is provided comprising a pulse power generation unit for generating N pulse signals with different power levels, N is equal to or greater than 2; N microwave power generation units for, under the control of a control signal, generating N microwaves with different energy levels based on said N pulse signals, respectively; a power mixing unit having N entrances and one exit and for inputting a corresponding microwave among said N microwaves from each of said N entrances and outputting said N microwaves from said one exit; a particle beam generation unit for generating N particle beams in synchronization with said N microwaves; and an accelerating unit for using said N microwaves to accelerate said N particle beams, respectively.

According to an embodiment of the present invention, the accelerator further comprises a single synchronization unit arranged between said power mixing unit and said accelerating unit and adapted to synchronize the characteristic frequency of said with the operating frequency of each of said N microwave power generation units.

According to an embodiment of the present invention, the accelerator further comprises N synchronization units arranged respectively between said N microwave power generation units and said power mixing unit and adapted to synchronize the characteristic frequency of said accelerating unit with the operating frequency of each of said N microwave power generation units, respectively.

According to an embodiment of the present invention, said synchronization unit comprises an incident wave sampling waveguide which samples each of the N microwaves outputted from said one exit of said power mixing unit to obtain an incident wave, a circulator which feeds each of the N microwaves into said accelerating unit and outputs a corresponding microwave reflected from said accelerating unit, a reflected wave sampling waveguide which samples the reflected corresponding microwave to obtain a reflected wave, an automatic phase-locking and frequency-stabilizing means which compares and analyzes said incident wave and said reflected wave and generates a synchro signal for synchronizing the operating frequency of each of said N microwave power generation units with the characteristic frequency of said accelerating unit, respectively, and an absorbing load which absorbs the reflected wave outputted by said circulator.

According to an embodiment of the present invention, said automatic phase-locking and frequency-stabilizing means comprises a variable attenuator for adjusting the amplitudes of said incident wave and said reflected wave and outputting an incident signal and a reflect signal, a phase discriminator for adjusting the phases of said incident signal and said reflect signal and outputting a first voltage and a second voltage, a preamplifier for amplifying the difference between said first and second voltages to output an adjust signal, a servo amplifier for amplifying said adjust signal to output a drive signal, and a channel selector for, under the control of a control signal, outputting said drive signal to a corresponding microwave power generation unit.

According to an embodiment of the present invention, said pulse power generation unit comprises a single pulse power source which, under the control of a control signal, supplies power to said N microwave power generation unit in a time division manner.

According to an embodiment of the present invention, said pulse power generation unit comprises N pulse power sources which, under the control of a control signal, supply power to said N microwave power generation unit, respectively, at different time points.

According to an embodiment of the present invention, said particle beam generation unit comprises an electron gun for generating an electron beam and a gun power supply for supplying power to said electron gun.

According to an embodiment of the present invention, said power mixing unit comprises N−1 mixing loops each of which has two entrances and one exit, where the length difference between the central arcs of the two microwave paths from one of the entrance to the other equals an integral multiple plus half of the wavelength of a guiding wave, the length difference between the central arcs of the two microwave paths from said one entrance to said exit equals an integral multiple of the wavelength of the guiding wave, and the length difference between the central arcs of the two microwave paths from said other entrance to said exit equals an integral multiple of the wavelength of the guiding wave.

In a further aspect of the present invention, a multi-energy frequency-multiplying particle accelerator is provided comprising a pulse power generation unit for generating N pulse signals with the same power level, N is equal to or greater than 2; N microwave power generation units for, under the control of a control signal, generating N microwaves with the same energy level based on said N pulse signals, respectively; a power mixing unit having N entrances and one exit and for inputting a corresponding microwave among said N microwaves from each of said N entrances and outputting said N microwaves from said one exit; a particle beam generation unit for generating N particle beams in synchronization with said N microwaves; and an acceleration unit for using said N microwaves to accelerate said N particle beams, respectively.

In a further aspect of the present invention, a method of particle beam acceleration is provided comprising steps of: generating N pulse signals with different power levels, N is equal to or greater than 2; generating N microwaves with different energy levels based on said N pulse signals, respectively, under the control of a control signal; using a power mixing unit having N entrances and one exit to mix said N microwaves, where a corresponding microwave among said N microwaves is inputted from each of said N entrances and said N microwaves are outputted from said one exit; generating N particle beams in synchronization with said N microwaves; and using said N microwaves to accelerate said N particle beams, respectively.

In still a further aspect of the present invention, a method of particle beam acceleration is provided comprising steps of: generating N pulse signals with the same power level, N is equal to or greater than 2; generating N microwaves with the same energy level based on said N pulse signals, respectively, under the control of a control signal; using a power mixing unit having N entrances and one exit to mix said N microwaves, where a corresponding microwave among said N microwaves is inputted from each of said N entrances and said N microwaves are outputted from said one exit; generating N particle beams in synchronization with said N microwaves; and using said N microwaves to accelerate said N particle beams, respectively.

By applying the multi-energy frequency-multiplying particle accelerator of the present invention to substance identification in the field of radiation scanning imaging technology, images of an object under different radiation energy levels can be acquired during one round of scanning with only one accelerator and one set of detector and imaging system. Therefore, it is possible to implementing rapidly object imaging and substance identification and thus to effectively find out dynamites, drugs, weapons or other poisonous substance and contraband goods hidden in large-sized containers during trans-border shipping. Meanwhile, the accelerator has a considerably improved processing efficiency due to its high operating frequency and fast scanning imaging operation. Thus, as compared with the existing solutions employing two accelerators, the inventive accelerator has a reduced number of devices, less occupied area and lower expenditure with fast scanning imaging operation and high processing efficiency.

The multi-energy frequency-multiplying particle accelerator of the present invention can be widely applied in other fields of radiation, such as radiotherapy, radiation sterilization, radiation quarantine, radiation decomposition, radiation crosslinking and radiation modification. Different radiation processing energy levels can be selected for different processing subjects so as to achieve better effect of processing. Furthermore, thanks to the use of multiple microwave power sources, the accelerator gives multiplied operating efficiency, higher power and thus enhanced radiation processing capability.

BRIEF DESCRIPTION OF THE DRAWINGS

The embodiments of the present invention will be described based on, but not limited to, examples and accompanied figures, throughout which like reference numbers designate corresponding, like or similar elements.

DETAILED DESCRIPTION OF THE PREFERRED EMBODIMENTS

Many specific details about the present invention will be elaborated in the following description to ensure a complete and thorough understanding of each example. On the other hand, those ordinarily skilled in the art will appreciate that the embodiments of the present invention can be realized even without these specific details. Besides, the concrete explanation of any well-know method, procedure, part or circuit will be omitted so as not to obscure the object of the present invention.

Figure 1:
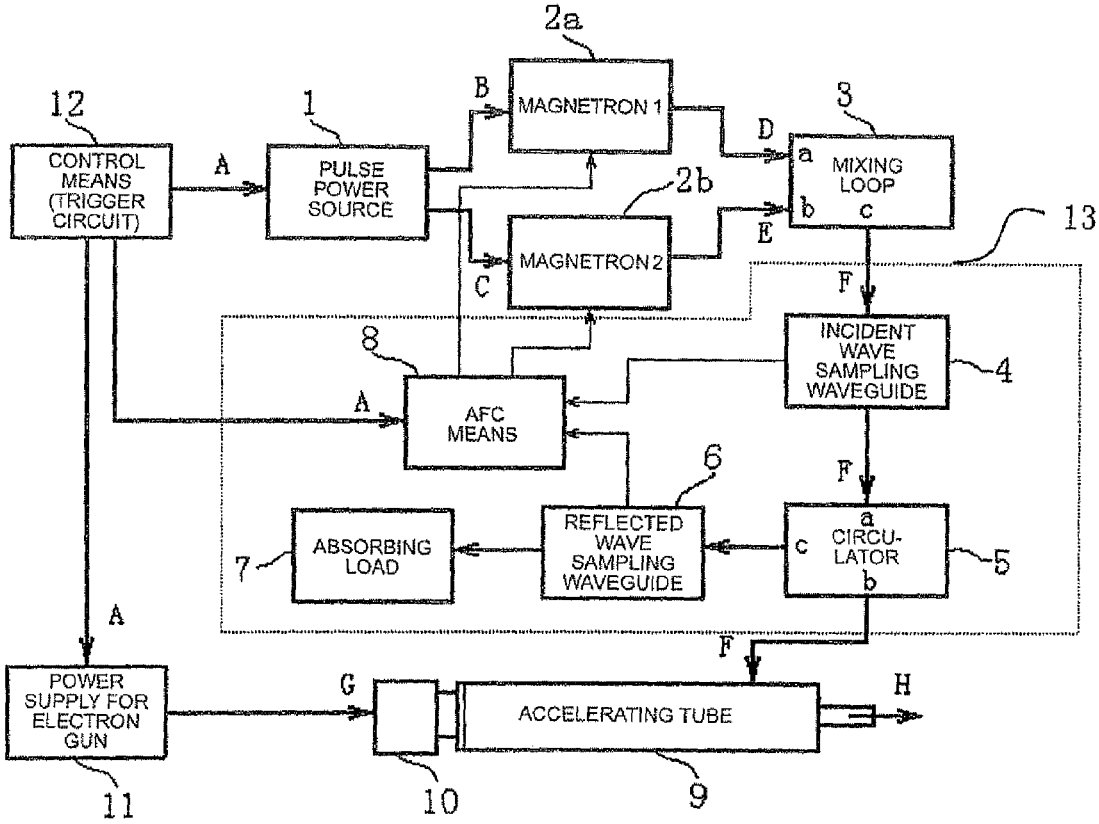
FIG. 1 shows a schematic block diagram of a dual-energy frequency-multiplying electron linac (linear accelerator) according to the first embodiment of the present invention.

FIG. 1 shows a schematic block diagram of a dual-energy frequency-multiplying electron linac according to the first embodiment of the present invention. As shown in FIG. 1, the dual-energy frequency-multiplying electron linac according to the first embodiment of the present invention consists primarily of a pulse power source 1, microwave power sources 2*a*, 2*b* such as magnetrons, a power mixer 3, an incident wave sampling waveguide 4, a circulator 5, a reflected wave sampling waveguide 6, an absorbing load 7, an AFC means 8, an accelerating tube 9, an electron gun 10, a power supply for electron gun 11 and a control means 12 such as a trigger circuit. Among these parts, the incident wave sampling waveguide 4, the circulator 5, the reflected wave sampling waveguide 6, the absorbing load 7 and the AFC means 8 constitute a synchronization means 13 for synchronizing the characteristic frequency of the accelerating tube with the operating frequencies of the microwave power sources 2*a*, 2*b*.

Figure 2:
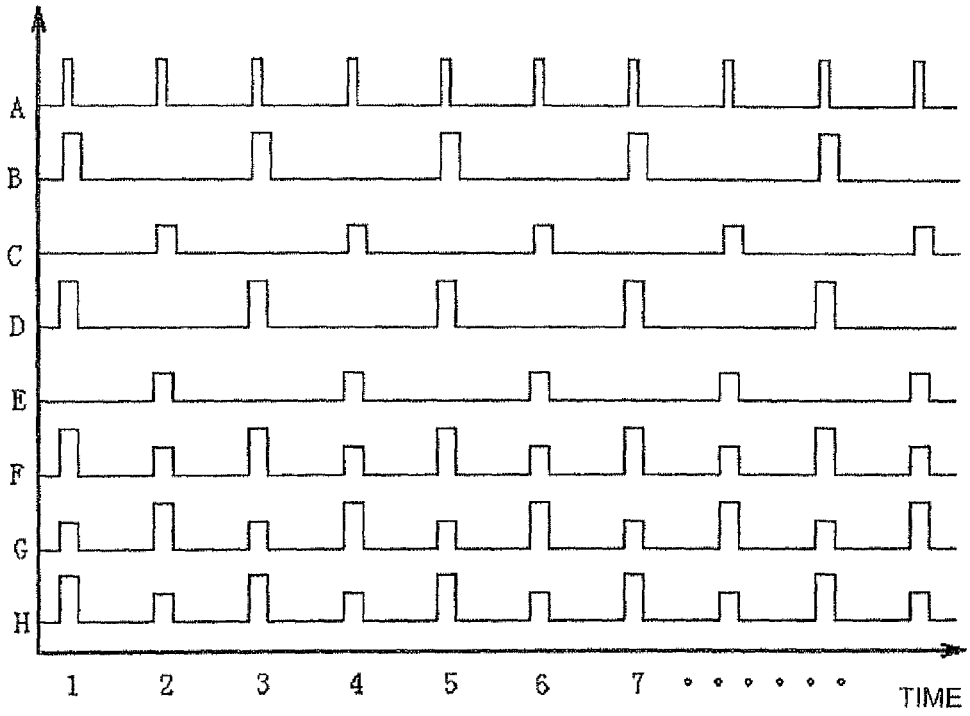
FIG. 2 shows a timing chart of respective parts of the dual-energy frequency-multiplying electron linac as shown in FIG. 1.

FIG. 2 shows a timing chart of respective primary parts of the dual-energy frequency-multiplying electron linac as shown in FIG. 1 as well as the relative intensities of voltage, current, microwave power or electron beam energy generated by these parts. Reference sign A denotes a trigger pulse sequence generated by the control means 12, Reference sign B denotes a set of pulse voltage outputted from the pulse power source 1, Reference sign C denotes another set of pulse voltage outputted from the pulse power source 1 with the amplitude being smaller than the pulse voltage B, Reference sign D denotes the microwave power generated by the magnetron 2*a* to which the pulse voltage B is applied, Reference sign E denotes the microwave power generated by the magnetron 2*b* to which the pulse voltage C is applied, the amplitude thereof being smaller than the microwave power D, Reference sign F denotes the output after the mixing of the microwave power D and E in the power mixer 3, Reference sign G denotes the high voltage of different amplitudes generated by the power supply for electron gun 11, and Reference sign H denotes the two energy levels produced in the accelerating tube 9.

As shown in FIGS. 1 and 2, the control means 12 triggers and controls the action of the pulse power source 1 at a timing of the trigger pulse sequence A. At to the first time point, i.e. the first trigger pulse in the sequence A, the pulsed power source 1 activates the magnetron 2*a* with larger power to produce an output of larger microwave power. This microwave output enters the accelerating tube 9 via the mixer 3, the incident wave sampling waveguide 4 and the circulator 5.

The control means 12 also triggers the power supply for electron gun 11 at the same time as the trigger of the pulse power source 1. The power supply for electron gun 11 produces a gun high voltage of smaller amplitude at the first time point. Upon applied with such gun high voltage, the electron gun 10 feeds a smaller number of electrons into the accelerating tube 9, in which, these electrons are accelerated with the above larger power and thus obtain a higher energy level.

At the second time point, i.e. the second trigger pulse in the sequence A, the pulse power source 1 activates the magnetron 2*b* with smaller power to produce an output of smaller microwave power. This microwave output enters the accelerating tube 9 via the mixer 3, the incident wave sampling waveguide 4 and the circulator 5.

The control means 12 also triggers the power supply for electron gun 11 at the same time as the trigger of the pulse power source 1. The power supply for electron gun 11 produces a gun high voltage of larger amplitude at the second time point. Upon applied with such gun high voltage, the electron gun 10 feeds a larger number of electrons into the accelerating tube 9, in which, these electrons are accelerated with the above smaller power and thus obtain a lower energy level.

The overall operations of the accelerator at both the first and second time points are defined as one cycle. Electron beams of alternating higher and lower energy levels can be produced as the accelerator repeats the above cycle every two subsequent time points. The unconsumed microwave power reflected by the accelerating tube 9 enters the absorbing load 7 via the circulator 5 and the reflected wave sampling waveguide 6 and is completely absorbed by the absorbing load 7. The AFC means 8 acquires the information on the incident wave and the reflected wave from the incident wave sampling waveguide 4 and the reflected wave sampling waveguide 6, respectively, compares and analyzes the information and then, under the control of the control means 12, adjusts the operating frequencies of the magnetron 2*a* and 2*b*, respectively, so that these frequencies can match the resonant frequency of the accelerating tube 9 and thus the effectiveness of acceleration on the electron beams can be guaranteed.

In this way, electron beams of two different energy levels are obtained within a single accelerator system by using two microwave power sources, with the frequency of accelerating operation being twice higher than that of a single microwave power source.

In the above dual-energy frequency-multiplying electron linac according to the first embodiment of the present invention, the magnetron is used as the microwave power source to produce microwave. A klystron can also be employed. Further, the accelerating tube 9 can be either a standing-wave accelerating tube or a traveling-wave accelerating tube.

In addition, the number of the pulse power source 1 of the pulse modulator, for example, can be only one or two corresponding to the two magnetrons 2*a*, 2*b*, respectively. The circulator 5 serves as power isolation means, that is, the microwave produced by the magnetrons 2*a*, 2*b* can enters the accelerating tube 9, while the microwave power reflected back from the accelerating tube 9 can only enters the absorbing load 7 because of the one-direction isolation action of the circulator 5. Therefore, this can effectively prevent the reflected-back microwave from affecting the magnetrons 2*a*, 2*b*. The circulator 5 can be a three-port circulator or a four-port circulator. In the former case as shown in FIG. 1, the microwave power inputted via the port a will be outputted from the port b, and the microwave power inputted via the port b can exit only from the port c and never returns to the port a.

Figure 3:
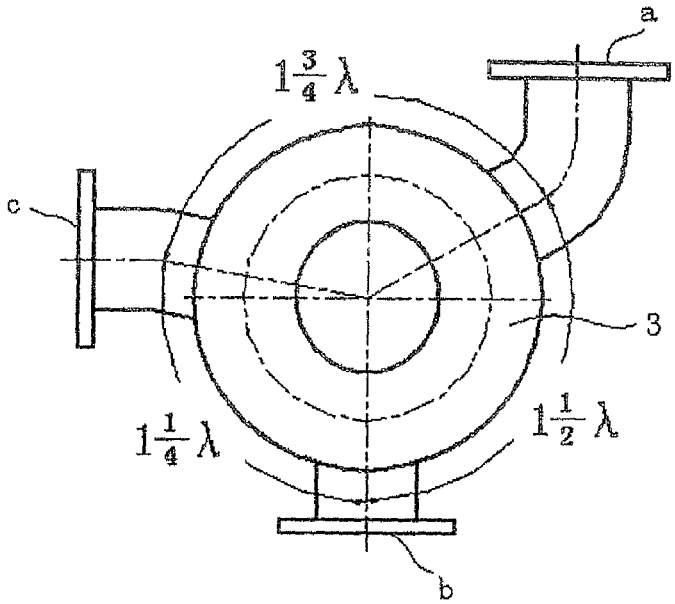
FIG. 3 shows a sectional view of a mixing loop as shown in FIG. 1.

FIG. 3 shows a sectional view of the mixing loop 3, which is a kind of power synthesizer having the main function of outputting from the one and same exit the microwave power incident via respective entrances at different time points. The basic structure of the mixing loop 3 is a circular loop with a rectangular section. Two entrances, i.e. entrances a and b, and one exit c are mounted at certain positions on the side wall of the mixing loop 3, the distribution of which positions depends on a specified wavelength relationship described later. In this manner, there are two paths for the passage of microwave between any two ports. Assume that $L_{ab}$, $L_{bc}$, $L_{ca}$ represent the length of the central arcs of the circle segments between the entrance a and entrance b, between the entrance b and the exit c as well as between the exit c and entrance a, respectively, the lengthen relationship holds as follows:

$$\begin{cases} L_{ab} + L_{bc} - L_{ca} = n\lambda_g \\ L_{bc} + L_{ca} - L_{ab} = n\lambda_g + \frac{1}{2}\lambda_g \\ L_{ca} + L_{ab} - L_{bc} = n\lambda_g \end{cases} \quad (1)$$

For example, $$\begin{cases} L_{ab} = 1\frac{1}{2}\lambda_g \\ L_{bc} = 1\frac{1}{4}\lambda_g \\ L_{ca} = 1\frac{3}{4}\lambda_g \end{cases} \quad (2)$$

In the equation set (1), n is an integral, $\lambda_g$ represents the wavelength in the waveguide tube of the microwave used by the accelerator. Among the equation set (1), the first equation indicates that the length different between the central arcs of the two microwave paths from the entrance a to the exit c is an integral multiple of the wavelength, the second equation indicates that the length different between the central arcs of the two microwave paths from the entrance a to the entrance b is an integral multiple plus half of the wavelength, and the third equation indicates that the length different between the central arcs of the two microwave paths from the entrance b to the exit c is an integral multiple of the wavelength.

As such, the microwave power, that has entered from one of the entrances a, b, propagates along two different paths. As a result, there appears the positive add-up of the two paths of microwave at the exit c, resulting in the microwave power consistent with that at said entrance. This resulting microwave power is outputted from the exit c. At the other entrance, however, there is the negative add-up of the two paths of microwave, resulting in the power of zero. So the microwave cannot exit from the other entrance. In this way, the microwave power inputted into the mixing loop 3 via either the entrance a or the entrance b will be sent out from the exit c as it is inputted.

Figure 4:
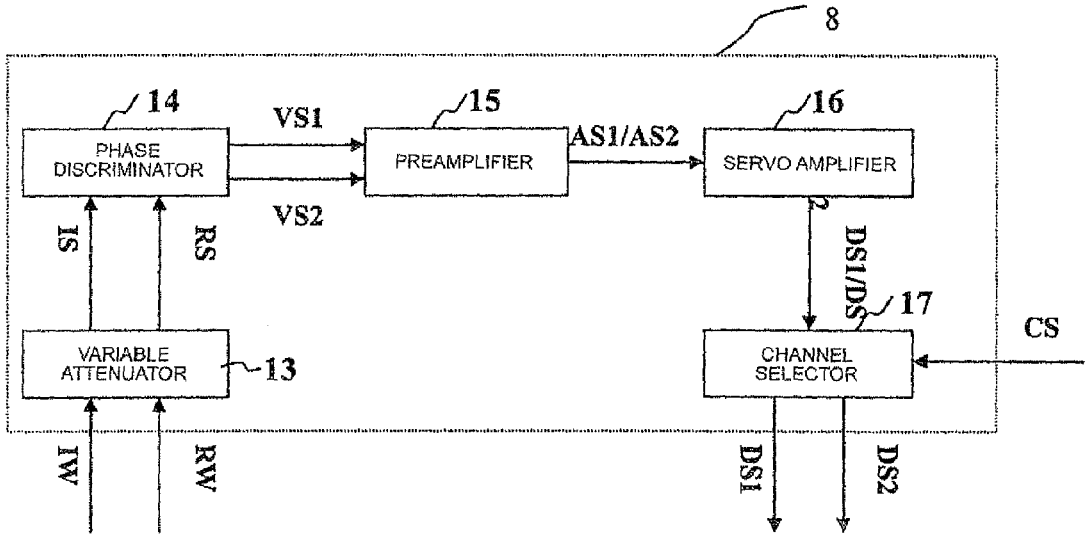
FIG. 4 shows a block diagram of AFC means as shown in FIG. 1.

FIG. 4 is a schematic block diagram of the AFC means 8 as shown in FIG. 1. The AFC means 8 comprises a variable attenuator 13, a phase discriminator 14, a preamplifier 15, a servo amplifier 16 and a channel selector 17. An incident signal IS and a reflect signal RS, which are outputted after the incident wave IW and the reflected wave RW has undergone the amplitude adjustment by the variable attenuator 13, enters the phase discriminator 15 for phase adjustment and synthesis, as a result of which, two voltage signals VS1 and VS2 are outputted. The preamplifier 15 compares the two voltage signals VS1 and VS2 and amplifies the difference between them so as to output an adjust signal AS1. Also, the AFC means 8 produces another adjust signal AS2 for another pair of incident and reflected wave. The adjust AS1 or AS2 is further amplified by the servo amplifier 16 to output a drive signal DS1 or DS2.

The channel selector 17, to which the control signal Cs fed by the control means 12 is applied, sends the drive signals DS1 and DS2 to the magnetrons 2*a* and 2*b*, respectively, at different time points so that the operating frequencies of the magnetrons 2*a* and 2*b* can be adjusted as consistent with the characteristic frequency of the accelerating tube 9, thereby ensuring the stability of the overall system operation. The channel selector 17 can has more than two output channels, the specific number of which should be the same as that of the microwave power sources in a multi-energy frequency-multiplying electron linac system.

The structure and operating procedure of the multi-energy frequency-multiplying electron linac of the present invention has been explained by taking as an example the case in which the circulator 5 is arranged between the power synthesizer and the accelerating tube. Alternatively, the circulator 5 can be arranged between the respective microwave power sources and the mixing loop.

Figure 5:
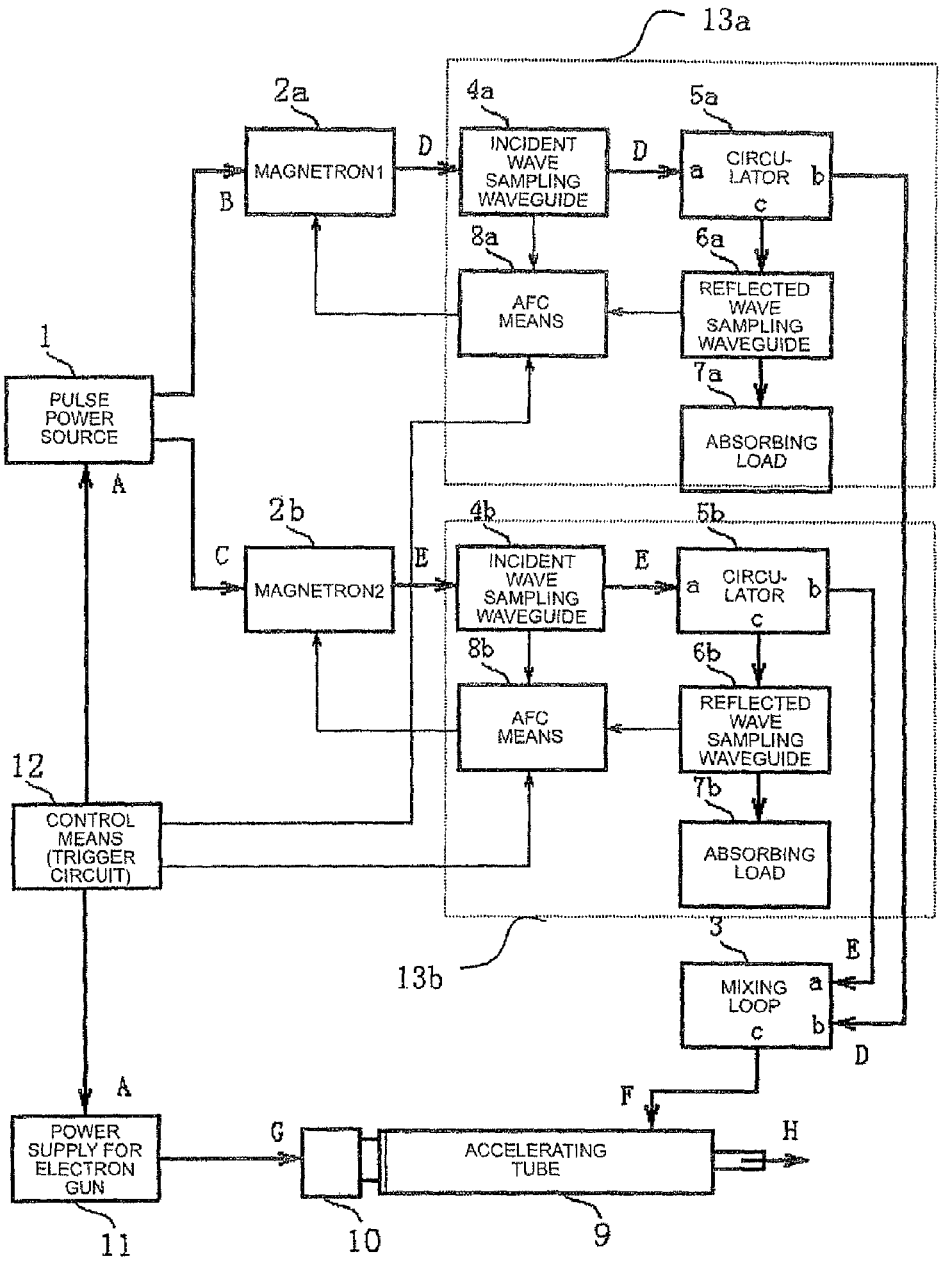
FIG. 5 shows a variation of the dual-energy frequency-multiplying electron linac according to the first embodiment of the present invention, in which a circulator is mounted between each magnetron and a mixing loop.

FIG. 5 shows a variation of the dual-energy frequency-multiplying electron linac according to the first embodiment of the present invention, in which the circulators 5 are mounted between the respective magnetrons and the mixing loop. In this arrangement mode, the number of each member from the group of the incident wave sampling waveguides 4*a*, 4*b*, the circulators 5*a*, 5*b*, the reflected wave sampling waveguides 6*a*, 6*b*, the absorbing load 7*a*, 7*b* and the AFC means 8*a*, 8*b* is the same as that of the magnetrons used as the microwave power source. With such configuration, although the number of necessary elements is increased and thus the system appears more intricate when compared with the configuration as shown in FIG. 1, the key elements, such as the circulator 5*a*, 5*b* and the absorbing load 7*a*, 7*b*, are loaded with less power in the system, that is, each of them will bear only the power produced by a single microwave power source. Consequently, these elements can be realized in a technically easier way, and the circulator and absorbing load of lower power have lower cost.

Similarly to the above description, the incident wave sampling waveguides 4*a*, the circulators 5*a*, the reflected wave sampling waveguides 6*a*, the absorbing load 7*a* and the AFC means 8*a* forms a synchronization means 13*a* for synchronizing the characteristic frequency of the accelerating tube 9 with the operating frequency of the microwave power source 2*a*, while the incident wave sampling waveguides 4*b*, the circulators 5*b*, the reflected wave sampling waveguides 6*b*, the absorbing load 7*b* and the AFC means 8*b* forms a synchronization means 13*b* for synchronizing the characteristic frequency of the accelerating tube 9 with the operating frequency of the microwave power source 2*b*.

With this configuration, the operation timing and principle of the overall system are basically the same as that shown in FIG. 1 except the difference that the unconsumed microwave power reflected by the accelerating tube 9 enters the mixing loop 3 via the port c and exits from the port a and b as two separate parts to the two circulator 5*a*, 5*b*, respectively; then the two parts enters the absorbing load 7*a*, 7*b* via the reflected wave sampling waveguides 6*a*, 6*b*, respectively, and are fully absorbed by the absorbing load 7*a*, 7*b*.

Similarly, the AFC means 8*a*, 8*b* also acquires the information on the incident and reflected wave from the incident wave sampling waveguides 4*a*, 4*b* and the reflected wave sampling waveguides 6*a*, 6*b*, respectively, compares and analyzes the information while operating under the control of the control means 12. Now, for each of the AFC means 8*a*, 8*b*, only one output path is needed for frequency adjustment on the corresponding magnetron 2*a* or 2*b*.

While a description has been give to the structure and operating procedure of the dual-energy frequency-multiplying electron linac according to the first embodiment of the present invention, the present invention can be applied to the configuration having more than two pulse power sources.

Figure 6:
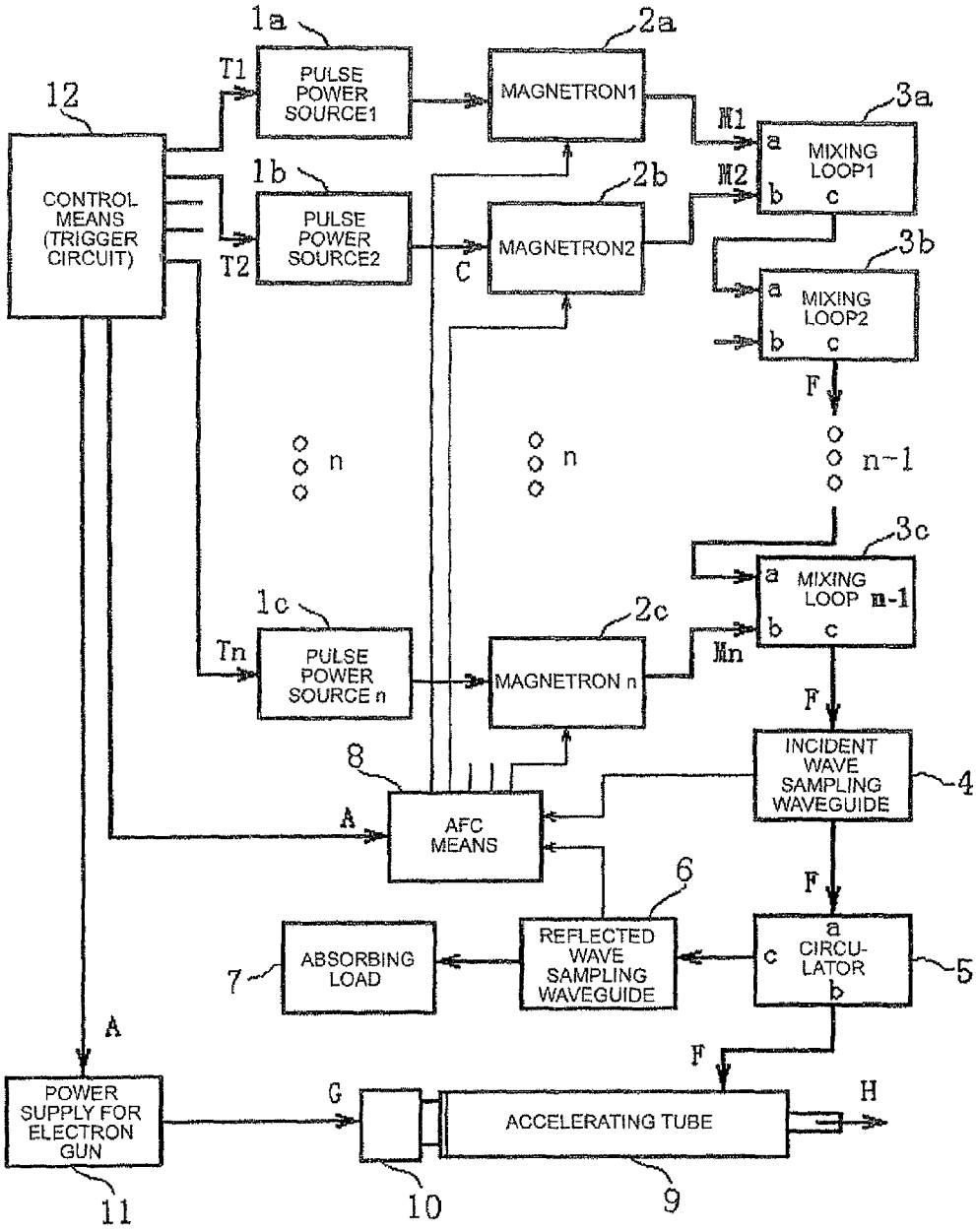
FIG. 6 shows a schematic block diagram of a multi-energy frequency-multiplying electron linac according to the second embodiment of the present invention.

FIG. 6 shows a schematic block diagram of a multi-energy frequency-multiplying electron linac according to the second embodiment of the present invention, which is obtained by extending the dual-energy frequency-multiplying electron linac according to the first embodiment of the present invention.

In the electron linac according to the second embodiment of the present invention, additional pulse power sources, microwave power sources and power synthesizers can be appended in a cascaded fashion as many as required by the target application, and the operating principle of this linac is similar to that of the dual-energy frequency-multiplying electron linac. For example, FIG. 6 shows n pulse power sources 1*a*, 1*b*, . . . , 1*c*, *n* magnetrons 2*a*, 2*b*, . . . , 2*c*, and n−1 mixing loops 3*a*, 3*b*, . . . , 3*c*. Besides, the control means has n outputs T1, T2, . . . , Tn coupled to the n pulsed power sources, respectively, and the n magnetrons output M1, M2, . . . , Mn, respectively. On the other hand, the AFC means 8 has n outputs for controlling the n magnetrons, respectively.

Alternatively, the pulse power source can utilize only one pulse power source 1 and, under the control of the control means, outputs pulse power to n magnetrons in a time division manner.

Figure 7:
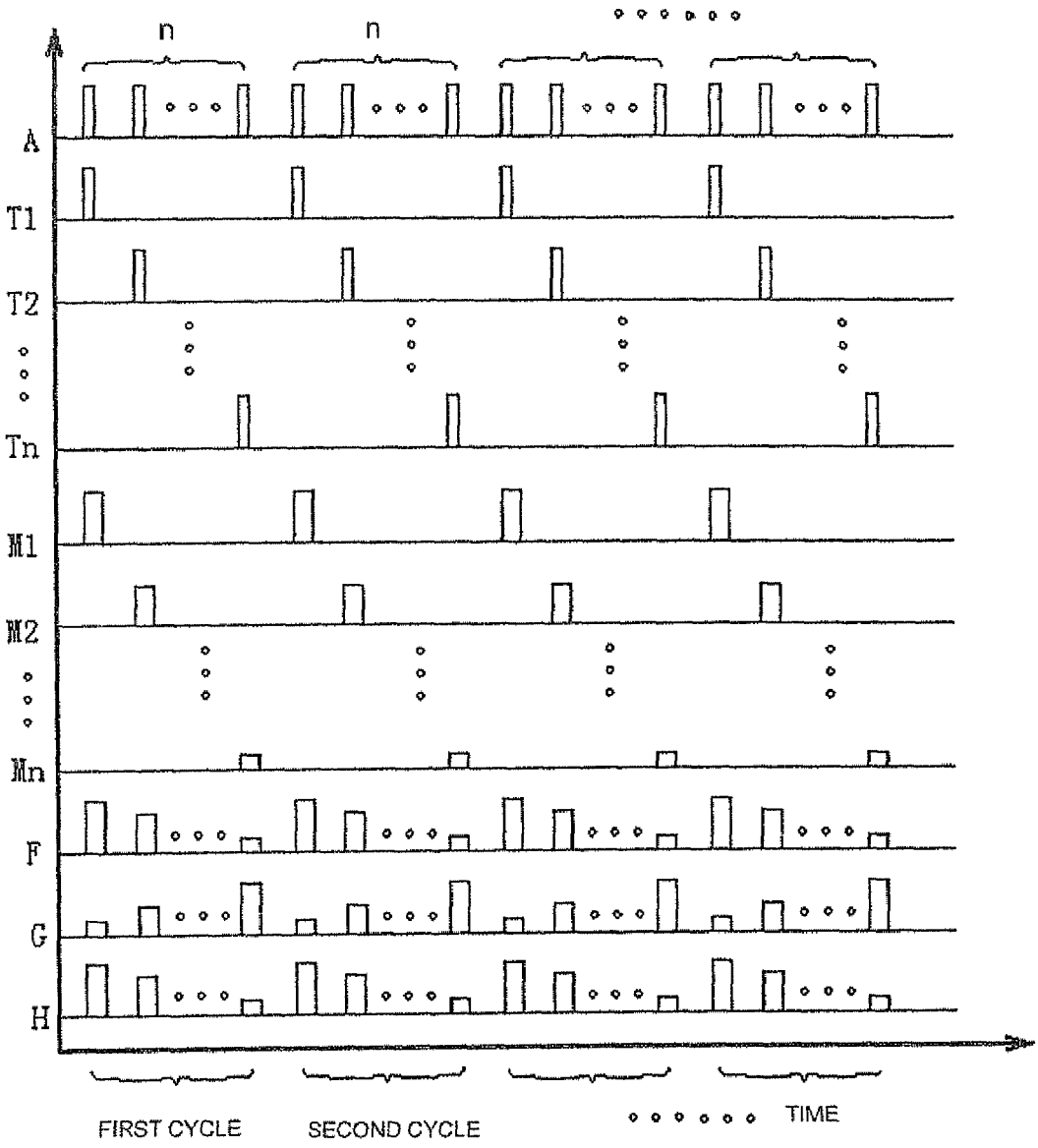
FIG. 7 shows a timing chart of respective parts of the multi-energy frequency-multiplying electron linac as shown in FIG. 6.

FIG. 7 shows a timing chart of respective parts of the multi-energy frequency-multiplying electron linac as shown in FIG. 6 as well as the relative intensities of voltage, current, microwave power or electron beam energy generated by these parts. Similarly to that shown in FIG. 2, the number of different energy levels outputted by the accelerator is the same as that of microwave power sources, and the operating frequency of the accelerator equals the result given by multiplying the operating frequency of an accelerator with a single microwave power source by the number of the microwave power sources.

Figure 8:
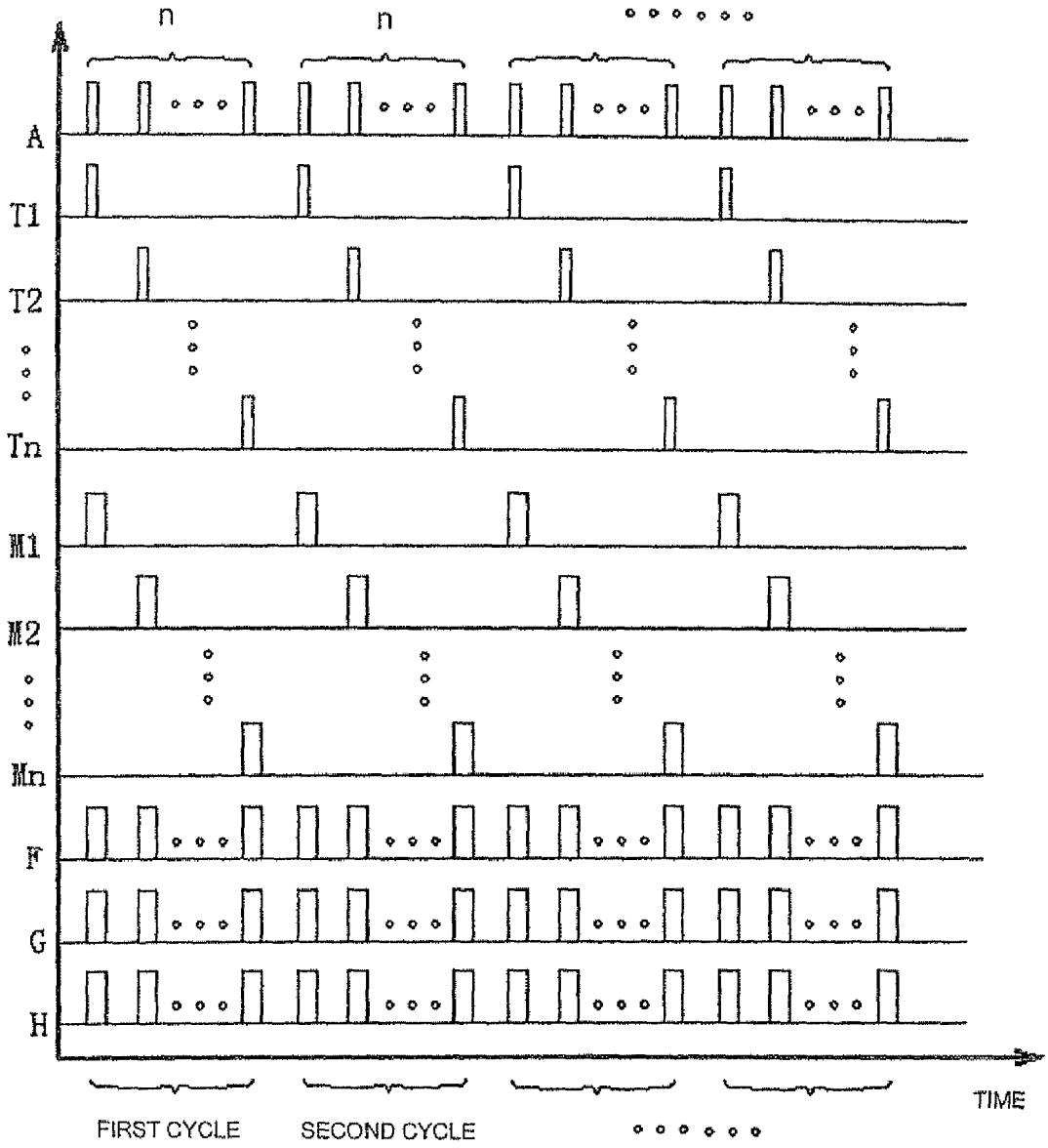
FIG. 8 shows a timing chart of respective parts of the multi-energy frequency-multiplying electron linac as shown in FIG. 6 when operating in a mono-energy frequency-multiplying status.

FIG. 8 shows a timing chart of respective parts of the multi-energy frequency-multiplying electron linac as shown in FIG. 6 when operating in a mono-energy frequency-multiplying status. In such status, all the microwave power sources output the same power, the power supply for electron gun also outputs the same high voltage at different time points, and thus the accelerator generates the electron beam of a single energy level. On the other hand, the electron beam power produced by this accelerator is n times higher than that of an accelerator with a single microwave power source. Therefore, this accelerator can be employed in such application as that requires power extension other than energy extension.

While the embodiments of the present invention have been explained by example of the electron linac, those ordinarily skilled in the art should appreciate that the present invention can be applied to acceleration on other particles.

The above illustrates and describes some features of the present invention. Those ordinarily skilled in the art will envisage many modification, substitution, change and equivalent to the present invention within the scope of the appended claims.

What is claimed is:

1. A multi-energy frequency-multiplying particle accelerator comprising:

a pulse power generation unit for generating N pulse signals with different power levels, N is equal to or greater than 2;

N microwave power generation units for, under the control of a control signal, generating N microwaves with different energy levels based on said N pulse signals, respectively;

a power mixing unit having N entrances and one exit and for inputting a corresponding microwave among said N microwaves from each of said N entrances and outputting said N microwaves from said one exit;

a particle beam generation unit for generating N particle beams in synchronization with said N microwaves; and an accelerating unit for using said N microwaves to accelerate said N particle beams, respectively.

2. The multi-energy frequency-multiplying particle accelerator of claim 1, further comprising a single synchronization unit arranged between said power mixing unit and said accelerating unit and adapted to synchronize the characteristic frequency of said accelerating unit with the operating frequency of each of said N microwave power generation units.

3. The multi-energy frequency-multiplying particle accelerator of claim 1, further comprising N synchronization units arranged respectively between said N microwave power generation units and said power mixing unit and adapted to synchronize the characteristic frequency of said accelerating unit with the operating frequency of each of said N microwave power generation units, respectively.

4. The multi-energy frequency-multiplying particle accelerator of claim 2, wherein said synchronization unit comprises:

an incident wave sampling waveguide which samples each of the N microwaves outputted from said one exit of said power mixing unit to obtain an incident wave;

a circulator which feeds each of the N microwaves into said accelerating unit and outputs a corresponding microwave reflected from said accelerating unit;

a reflected wave sampling waveguide which samples the reflected corresponding microwave to obtain a reflected wave;

an automatic phase-locking and frequency-stabilizing means which compares and analyzes said incident wave and said reflected wave and generates a synchro signal for synchronizing the characteristic frequency of said accelerating unit with the operating frequency of each of said N microwave power generation units, respectively; and an absorbing load which absorbs the reflected wave outputted by said circulator.

5. The multi-energy frequency-multiplying particle accelerator of claim 3, wherein each of said synchronization units comprises:

an incident wave sampling waveguide which samples the microwave outputted from a corresponding microwave power generation unit to obtain an incident wave;

a circulator which feeds said microwave into said power mixing unit and outputs the microwave reflected from said accelerating unit via said power mixing unit;

a reflected wave sampling waveguide which samples the reflected microwave to obtain a reflected wave;

an automatic phase-locking and frequency-stabilizing means which compares and analyzes said incident wave and said reflected wave and generates synchro signals for synchronizing the characteristic frequency of the microwave power generation units with the operating frequency of said accelerating unit , respectively; and an absorbing load which absorbs the reflected wave outputted by said circulator.

6. The multi-energy frequency-multiplying particle accelerator of claim 4, wherein said automatic phase-locking and frequency-stabilizing means comprises:

a variable attenuator for adjusting the amplitudes of said incident wave and said reflected wave and outputting an incident signal and a reflect signal;

a phase discriminator for adjusting the phases of said incident signal and said reflect signal and outputting a first voltage and a second voltage;

a preamplifier for amplifying the difference between said first and second voltages to output an adjust signal;

a servo amplifier for amplifying said adjust signal to output a drive signal; and a channel selector for, under the control of a control signal, outputting said drive signal to a corresponding microwave power generation unit.

7. The multi-energy frequency-multiplying particle accelerator of claim 1-3, wherein said pulse power generation unit comprises a single pulse power source which, under the control of a control signal, supplies power to said N microwave power generation unit in a time division manner.

8. The multi-energy frequency-multiplying particle accelerator of claim 1-3, wherein said pulse power generation unit comprises N pulse power sources which, under the control of a control signal, supply power to said N microwave power generation unit, respectively, at different time points.

9. The multi-energy frequency-multiplying particle accelerator of claim 1-3, wherein said particle beam generation unit comprises an electron gun for generating an electron beam and a gun power supply for supplying power to said electron gun.

10. The multi-energy frequency-multiplying particle accelerator of claim 1-3, wherein said power mixing unit comprises N−1 mixing loops each of which has two entrances and one exit, where the length difference between the central arcs of the two microwave paths from one of the entrance to the other equals an integral multiple plus half of the wavelength of a guiding wave, the length difference between the central arcs of the two microwave paths from said one entrance to said exit equals an integral multiple of the wavelength of the guiding wave, and the length difference between the central arcs of the two microwave paths from said other entrance to said exit equals an integral multiple of the wavelength of the guiding wave.

11. A multi-energy frequency-multiplying particle accelerator comprising:

a pulse power generation unit for generating N pulse signals with the same power level, N is equal to or greater than 2;

N microwave power generation units for, under the control of a control signal, generating N microwaves with the same energy level based on said N pulse signals, respectively;

a power mixing unit having N entrances and one exit and for inputting a corresponding microwave among said N microwaves from each of said N entrances and outputting said N microwaves from said one exit;

a particle beam generation unit for generating N particle beams in synchronization with said N microwaves; and an acceleration unit for using said N microwaves to accelerate said N particle beams, respectively.

12. A method of particle beam acceleration comprising steps of:

generating N pulse signals with different power levels, N is equal to or greater than 2;

generating N microwaves with different energy levels based on said N pulse signals, respectively, under the control of a control signal;

using a power mixing unit having N entrances and one exit to mix said N microwaves, where a corresponding microwave among said N microwaves is inputted from each of said N entrances and said N microwaves are outputted from said one exit;

generating N particle beams in synchronization with said N microwaves; and using said N microwaves to accelerate said N particle beams, respectively.

13. A method of particle beam acceleration comprising steps of:

generating N pulse signals with the same power level, N is equal to or greater than 2;

generating N microwaves with the same energy level based on said N pulse signals, respectively, under the control of a control signal;

using a power mixing unit having N entrances and one exit to mix said N microwaves, where a corresponding microwave among said N microwaves is inputted from each of said N entrances and said N microwaves are outputted from said one exit;

generating N particle beams in synchronization with said N microwaves; and using said N microwaves to accelerate said N particle beams, respectively.

* * * * *